United States Patent [19]

Martinez

[11] 4,318,513

[45] Mar. 9, 1982

[54] TENSION ADJUSTMENT SYSTEM OF THE PAPER BELT ON FEEDING UNITS OF PAPER MANUFACTURING MACHINES

[76] Inventor: Manuel T. Martinez, Sancho el Fuerte, 21 Pamplona, Spain

[21] Appl. No.: 160,848

[22] Filed: Jun. 19, 1980

[30] Foreign Application Priority Data

Jun. 21, 1979 [ES] Spain ..... 481.772

[51] Int. Cl.[3] ..... B65H 59/00

[52] U.S. Cl. ..... 242/75.53

[58] Field of Search ..... 242/75.53, 75.5, 75.51, 242/75.52

[56] References Cited

U.S. PATENT DOCUMENTS

| | | | |
|---|---|---|---|
| 2,343,181 | 2/1944 | Heinz | 242/75.53 X |
| 2,814,487 | 11/1957 | Medkeff | 242/75.53 |
| 3,558,074 | 6/1971 | Held | 242/75.53 |

*Primary Examiner*—Edward J. McCarthy

*Attorney, Agent, or Firm*—Eyre, Mann, Lucas & Just

[57] ABSTRACT

The invention relates to a system for providing a constant tension of the paper belt being fed from a paper coil. According to the invention, a floating roller is mounted between two displaceable trolleys, the ends of the roller shaft being slidably mounted in respective grooves of said trolleys. The trolleys are linked to chains which are provided with a common shaft which drives a piston rod of a cylinder. Two cylinders whose joint power is slightly smaller than that of the cylinder of the common shaft of the trolley chains are mounted to balance the pulling effect of the paper belt on the roller. Means for adjusting the brake pressure adjuster of the paper coils is provided on one of the trolleys. In accordance with the invention, an equilibrium of the oscillation of the floating roller is obtained so as to permit slight oscillations without affecting the pressure adjustment of the coil brakes.

8 Claims, 3 Drawing Figures

TENSION ADJUSTMENT SYSTEM OF THE PAPER BELT ON FEEDING UNITS OF PAPER MANUFACTURING MACHINES

In the paper manufacturing facilities for the manufacture of ondulated cardboard or any other destination, the supply is carried out starting off from the basis of paper coils on a continuous belt. In order to avoid interruptions in the supply the use of automatic linking elements is well known which carry out the splicing of the paper belt of the old belt with the paper belt of the new standby coil, carrying out this operation without interrupting the unit's operation.

It is also known that on the automatic splicers a supply of paper is tried to be obtained with a constant prefixed tension, thus cancelling the possible accidental variations of said tension which can occasionally take place.

A specific solution to this problem is known due to same having been object of the Spanish Invention Patent No. 451,946 of this same applicant, which consists in the fact that the fore roller of the paper storage is mounted in a floating manner, being balanced between the pull effect of the paper itself and the push of some cylinders, and in such a way that a relationship is established between the movement of said roller and the brakes which actuate upon the supplying coils, so that the paper variation tensions shall adjust by themselves the braking force of the pertinent coil in order to maintain the above mentioned tension constancy.

However, with the specific solution presented within the patent under consideration, there are still some inconveniences such as, for examples, the appearance of vibrations and sideway movements of the floating roller when the coil presents deformations upon not being perfectly circular, which is a frequent thing and then as the relation between said floating cylinder and the adjustment of the brakes of the coils is practically rigid small variations cannot be compensated which are due to the above mentioned deformations, for example, and elliptic section of the coil which upon wanting to compensate the mechanism the successive and contrary variations of tension that the bigger and smaller diameter of the coil would create would make the mechanism vibrate. On the other hand, with the previously mentioned front roller being mounted and suspended from the crankshafts of the cylinders, the effort supported by the cylinders actuating upon same varies in function of the position of said roller, as when the roller is not in perfect vertical suspension in relation to the body of the cylinder its weight carries out an influence in the sense that the maintained tension does not turn out to be constant.

This invention proposes a solution with new particularities which eliminate the previously mentioned inconveniences.

The solution for this invention consists in the front floating roller being mounted between two displaceable trolleys, with the ends of its shaft included in respective grooves of said trolleys, with the trolleys being linked to chains which are provided with a common shaft which is related, by means of a pinion, to the rod-rack of a cylinder, actuating upon the ends of the front roller with another two cylinders whose joint power is slightly smaller than that of the cylinder related to the common shaft of the trolley chains, whilst one of the above mentioned trolleys, between which the front roller is mounted, has a wedge which actuates upon the brake pressure adjuster of the paper supplying coils.

With this solution an equilibrium of the oscillations of the floating roller is obtained with the variations of paper tension, for maintaining said tension constant, with the tension being regulated throughout all the transverse dimension of the paper belt and in this case the weight of the roller itself has no influence upon the adjustment of tension, with the tension always being constant, whilst on the other hand, the assemblage on which the roller goes permits same to have slight oscillations without affecting the pressure adjustment of the coil brakes, with which the small paper tension variations, due to deformations of the supplying coil and to similar causes, they can be perfectly compensated without any brusque oscillations taking place on the roller.

Nevertheless, when the tension variations pertain to other causes and are more important, as for example the progressive variation of the diameer of the coils upon being consumed, then also with this solution the adjustment of the power of the brakes of the coils takes place thanks to the oscillation of the floating roller, with which the tension is maintained constant at all times.

Figure 1:
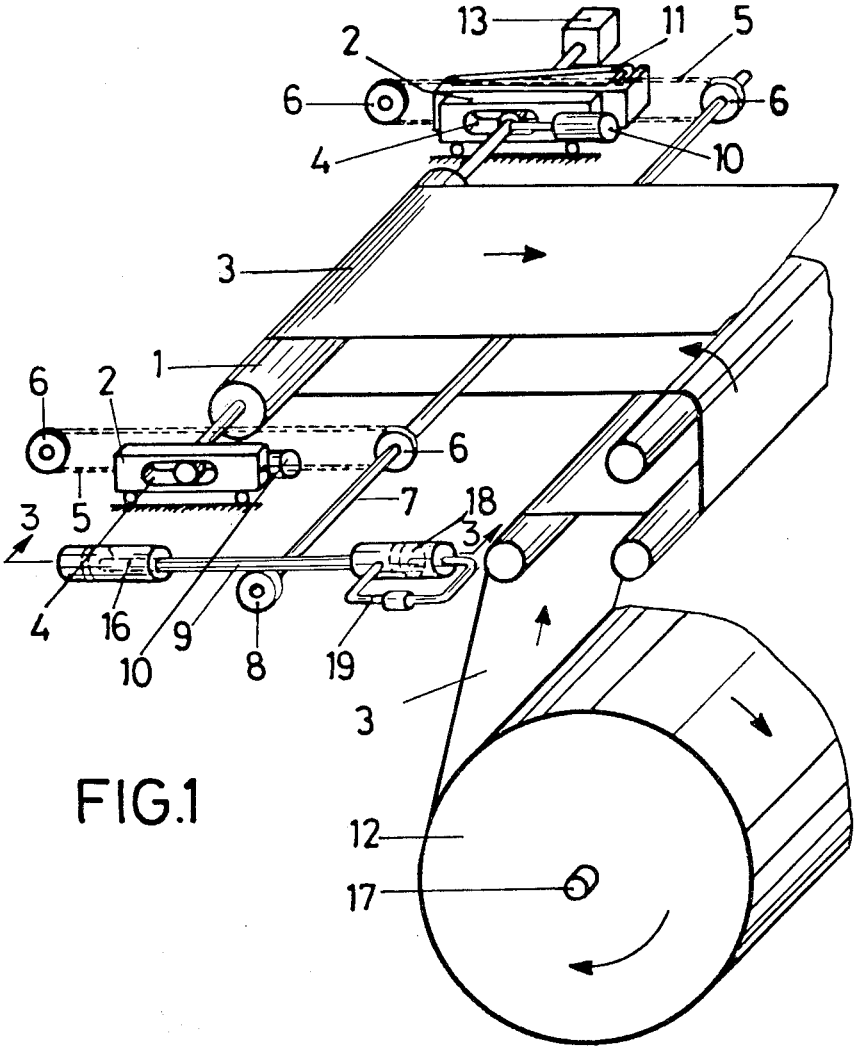
FIG. 1 shows a schematic representation in perspective of the layout of a floating roller as per the above mentioned improvements.
Figure 2:
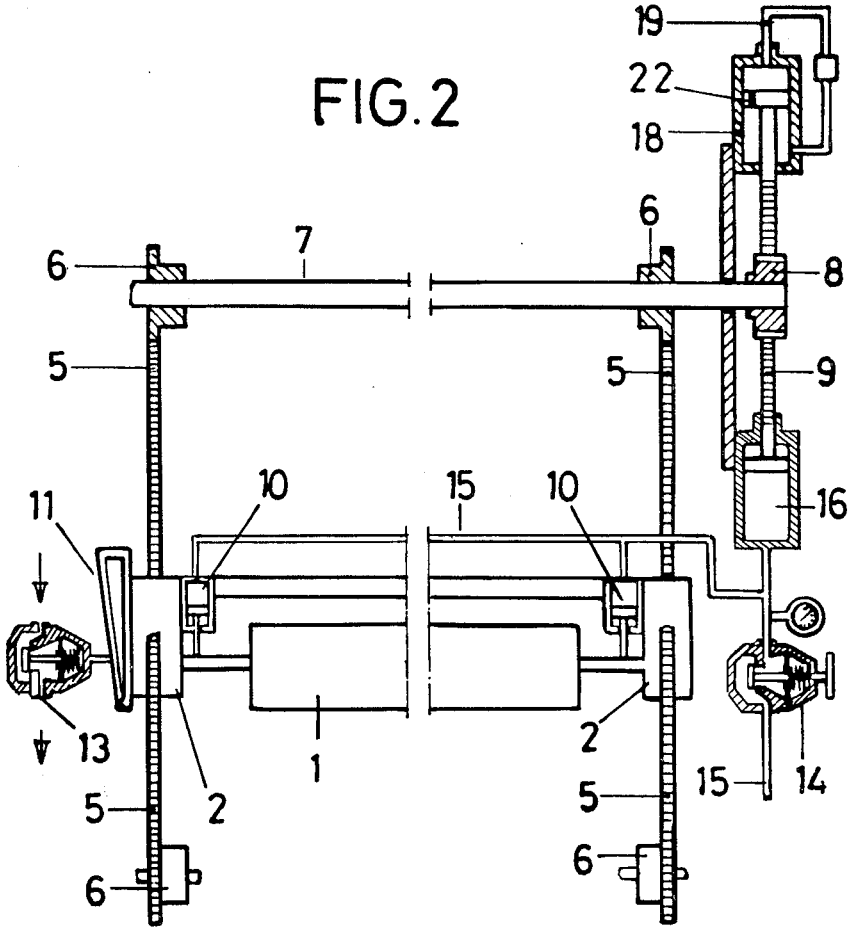
FIG. 2 is a top representative view in a schematic way of the same layout of the floating roller, thus being able to see the hydraulic assembly of the unit.
Figure 3:
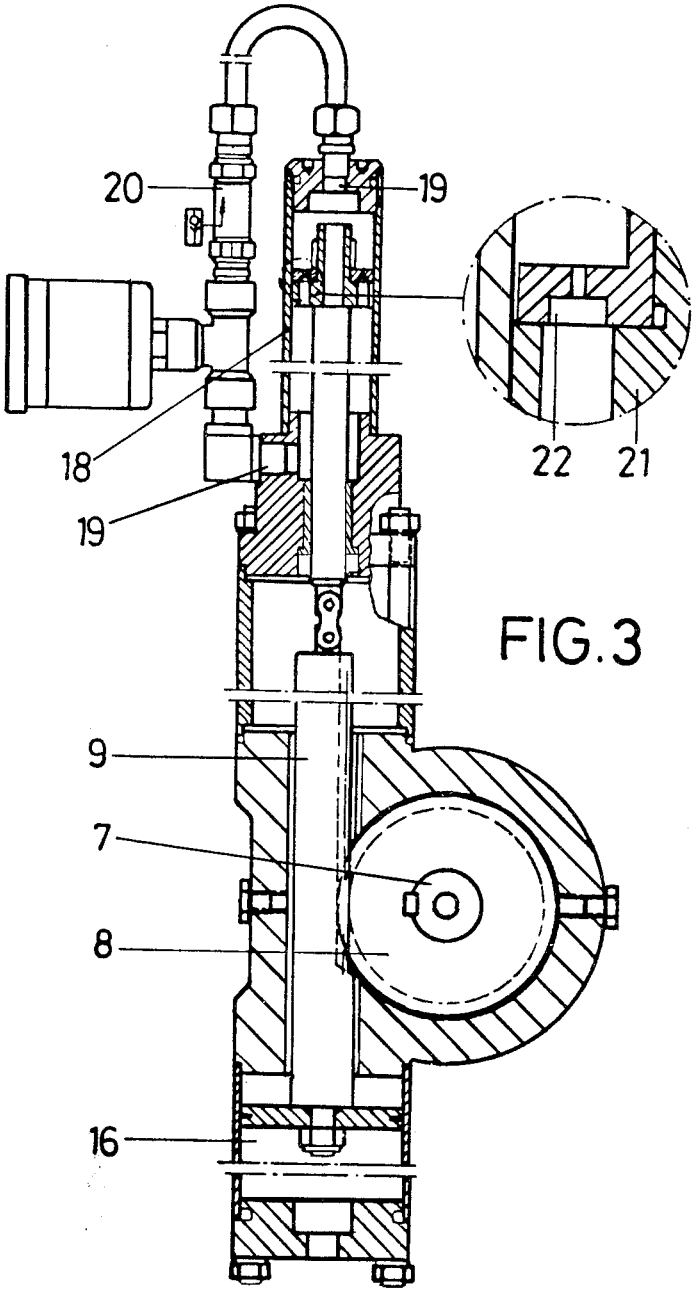
FIG. 3 is a section taken along the line 3—3 of FIG. 1 and in greater detail.

The indicated references are the following:

1.—Front floating roller
2.—Displaceable trolley
3.—Paper belt
4.—Trolley groove (2)
5.—Chain
6.—Chain pinion (5)
7.—Common shaft of the pinions (6) and pinion (8)
8.—Pinion
9.—Rod with cylinder rack cutting (16)
10.—Fluid cylinder which actuates upon the roller (1)
11.—Wedge
12.—Paper belt coil
13.—Coil brake pressure adjuster (12)
14.—Manual pressure adjuster
15.—Cylinder feed conduit (10 and 16)
16.—Fluid cylinder
17.—Coil shaft
18.—Fluid antagonist cylinder, cylinder absorber (16)
19.—Cylinder fluid closed circuit (18)
20.—Single direction valve
21.—Plunger
22.—Narrow conduit.

As per the invention, the front floating cylinder (1) of the assembly of the feeding device, is mounted between trolleys (2) which can be moved in the same direction as the paper (3), thus being mounted with the inclusion of the ends of its shaft within grooves (4) of the above mentioned trolleys (2).

Each one of the trolleys (2) is linked to a chain (5) which is laid out between pinions (6), of which one pertains to each chain (5) and have a common shaft (7) which by means of a pinion (8) is related to the rod-rack (9) of a cylinder (16).

On the other hand, actuating upon the ends of the roller itself (1) there are another two cylinders (10), which receive a common feed (15) which comes from the same feed of the cylinder (16) with the ensemble remaining in such a way that the joint force of said cylinders (10) actuating upon the roller (1) is slightly smaller than that of the mentioned cylinder (16) related to shaft (7) of the chains (5) of the trolleys (2).

In another matter of things, one of the above mentioned trolleys (2) has an incorporated wedge (11), of an inclination susceptible to variation, which is laid out, in a privileged way in relation to the regulator (13) destinated to control the pressure of the pertinent brakes (which are not shown) of the coils (12) which supply paper (3).

All of same when the paper (3) which is being supplied undergoes a variation in tension, said variation is compensated with the oscillation of the roller, permitted by the cylinders (10), in such a way that between said variation and said oscillation an equilibrium is established which recovers the normal prefixed tension, with which said tension tends to remain constant at all times.

Now when the variations in tension are small, being due to deformations of the supplying coil (12), or due to similar causes, then the roller (1) is only affected by small oscillations, in which it moves within the play that the grooves (4) of the trolleys (2) permit, without there being any displacement of same, compensating the variation of the tension by the stress carried out by the cylinders (10).

But in another case, if the variations of tension respond to other causes and turn out be more intense, for example due to the successive variation of the coil diameter (12) when same is being consumed; then the oscillations of the roller (1) also turn out to be greater, in such a way that same in its displacement moves the trolleys (2), as the grooves (4) are not sufficient enough for the travel, and upon moving said trolleys (2) the chains (5) of same make the shaft rotate (7) against the cylinder's action (16).

When the trolleys move (2) the wedge (11) which one of them has incorporated actuates upon the regulator (13), in such a way that same consequently varies the brake's pressure (which does not appear) of the pertinent supplying coil (12) and makes the equilibrium be recovered maintaining paper tension constant (3).

In this way, if we suppose that the brake (which does not appear) actuates upon the shaft (17) of the coil (12) of paper with a $P_1$ braking pressure to which a paper belt (3) tension of $T_1$ pertains; it is evident that when the paper which is stored on the coil (12) is being used up its diameter decreases and at the same $P_1$ braking pressure it receives a $T_2$ paper tension value which is undesired as $T_2$ $T_1$ and we want to maintain constant tension. Then the systen actuates and upon moving the trolleys (2) it is actuated by means of the wedge (11) upon the regulator (13) of the brake pressure of the coils (12) until the new $P_2$ pressure is reached which reestablishes on the paper belt (3) the adequate $T_1$ tension. It is evident that $P_2$ $P_1$ at the rate that the diameter of the coil (12) is decreased for maintaining the tension ($T_1$) smaller braking pressures shall be applied.

With all the above we have then that, with this solution the small variations of paper tension (3) are simply compensated by the effort of the cylinders (10) which actuate directly upon the roller (1), thus avoiding any sort of brusqueness, as when the variation of the tension are progressive, the compensation of same has effect due to the effort of the cylinders (10) but at the same time due to the effort of the cylinder (16) and to an adequate variation of the braking of the pertinent supplying coil (12).

In any case, the pressure and therefore the effort of the cylinder (16) and consequently those of the cylinders (10) can be freely pre-established by means of the pertinent manual pressure regulator (14) which is incorporated within the feed conduit (15) of the above mentioned cylinders thus being able to adapt idoneous conditions to the tension which is required for each type of paper (3) which is used.

At the same time, in accordance with a particularity, the wedge (11) is foreseen with its inclinated plane in the possibility of being able to vary the inclination, which enable one to freely adjust the maximum braking capacity which is desired at the established pressure, being able to adapt the most idoneous conditions for each type of coil holder and as per the braking system which is used.

It is evident that this function of performance of the trolley (2) upon the brake pressure regulator (13), has been represented by the wedge (11); it can also be foreseen to carry out same with sliding electrical contacts, magnetic sensors, photoelectric sensors, etc., and in general with any other of the already-known means.

In order to avoid small reiterative faults of a contrary sign, for example those due to a coil (12) of elliptic section, from giving way to a starting-up of an undesired adjustment and for producing an alternative clicking noise phenomenon, the rack rod (9) is placed in opposition to an antagontist cylinder (18) which has a closed circuit (19) of fluid and incorporates in this closed circuit a uni-directtional valve (20) and in the plunger (21) of the cylinder (18) a narrow conduit (22). With all this the performance in one direction is not influenced as the fluid flows freely through the closed circuit (19) with this direction being that of a logical evolution which corresponds to counteract the increase of tension in the paper belt (3) due to a decrease of the coil (12) diameter but on the other hand in the opposite direction upon impeding the unidirectional valve (20) the passing of fluid, same is compelled to flow along the narrow conduit (22) thus making its passage difficult it therefore actuates as a shock absorber and thus for producing adjustment in the opposite direction (that of increasing the tension of paper belt) it will be necessary to have a greater perturbation which will have to be more persistent in time, having thus avoided alternative phenomena.

I claim:

1. A tension adjustment system for a paper belt of feeding units in paper manufacturing machines comprising:

(a) a front floating roller having a shaft therein;

(b) a pair of displaceable trolleys each trolley having a groove therein;

(c) said shaft being slideably mounted in the respective grooves of said displaceable trolleys for displacement therein;

(d) means mounted on each said trolley for compensating displacements of said shaft occurring within the limits of said grooves; and (e) said displaceable trolleys being displaceable in accordance with the presence of large variations in tension of said paper belt for control of said large variations, whereby small variations of paper tension are compensated within the displacement play of the shaft in the grooves of said trolleys without requiring the displacement of said trolleys.

2. The tension adjustment system of claim 1 wherein said displaceable trolleys are linked to respective chains which actuate a common shaft for driving a piston rod of a piston disposed in a fluid cylinder wherein displacement of the trolleys displaces said piston in said fluid cylinder against a predetermined adjustable pressure, said adjustable pressure being predeterminable from the desired paper belt tension.

3. The tension adjustment system of claim 2 further comprising an opposed plunger connected to said piston rod, said plunger being disposed in a cylinder, said plunger and cylinder forming part of a closed fluid pressure circuit, said closed fluid pressure circuit including a uni-directional valve, and wherein the plunger includes a narrow conduit therein whereby in the direction of increasing paper belt tension, there is substantially no influence of said plunger but in the opposed direction said plunger acts as a shock absorber for said piston rod.

4. The tension adjustment system of claim 1 wherein said means for compensating are a pair of cylinders acting on the floating roller, the floating roller cylinders having pistons slidably mounted therein, said pistons being connected on one end to the floating roller shaft and on the other side being connected to receive the predetermined air pressure fed to the fluid cylinder whose piston is connected to said common shaft.

5. The tension adjustment system of claim 4 wherein the joint power of said floating roller cylinders is slightly lower than that of the fluid cylinder whose displacement is controlled by the common shaft.

6. The tension adjustment system of claim 1 further comprising means for adjusting a brake pressure adjuster for adjusting the braking pressure of a paper supply roll in accordance with the position of said trolleys.

7. The tension adjustment system of claim 6 wherein the means for adjustment includes a wedge which upon displacement of the trolleys affects a coil brake pressure adjuster.

8. The tension adjustment system of claim 7 wherein the inclination of the wedge may be varied whereby the maximum desired brake action at a predetermined position of the common shaft may be adjusted.

* * * * *